US007448370B2

(12) United States Patent
Lu

(10) Patent No.: US 7,448,370 B2
(45) Date of Patent: Nov. 11, 2008

(54) PRACTICING APPARATUS FOR BASEBALL AND SOFTBALL

(76) Inventor: Sheng-Hsiao Lu, 23, Sia Mian Cuo, Gang Dong Cun, Si Gang Siang Tainan Sian (TW)

( * ) Notice: Subject to any disclaimer, the term of this patent is extended or adjusted under 35 U.S.C. 154(b) by 222 days.

(21) Appl. No.: 11/474,806

(22) Filed: Jun. 26, 2006

(65) Prior Publication Data

US 2007/0295318 A1 Dec. 27, 2007

(51) Int. Cl.
*F41B 4/00* (2006.01)

(52) U.S. Cl. ..... 124/6

(58) Field of Classification Search ..... 124/6, 124/78

See application file for complete search history.

(56) References Cited

U.S. PATENT DOCUMENTS 1,611,814 A * 12/1926 Butler ..... 124/78
3,774,584 A * 11/1973 Paulson ..... 124/78
3,794,011 A * 2/1974 Newgarden, Jr. ..... 124/78
4,026,261 A * 5/1977 Paulson et al. ..... 124/78
5,832,909 A * 11/1998 Grant et al. ..... 124/6

* cited by examiner

*Primary Examiner*—John Ricci
(74) *Attorney, Agent, or Firm*—Alan Kamrath; Kamrath & Associates PA

(57) ABSTRACT

A baseball and softball practicing apparatus includes a stand, a housing mounted on the stand, a ball throwing wheel mounted in the housing, and a feeding member mounted on the housing. Thus, the hooks of the feeding member are hooked onto the transverse stubs of the housing, the movable plate of the feeding member is inserted into the slideway of the housing, and the threaded rod is screwed into the housing and extended through the movable plate of the feeding member to secure the feeding member to the housing, so that the feeding member is mounted on and detached from the housing easily and quickly by rotation of the threaded rod, thereby facilitating the user assembling and disassembling the feeding member.

18 Claims, 9 Drawing Sheets

PRACTICING APPARATUS FOR BASEBALL AND SOFTBALL

BACKGROUND OF THE INVENTION

1. Field of the Invention

The present invention relates to a practicing apparatus, and more particularly to a baseball and softball practicing apparatus.

2. Description of the Related Art

A conventional baseball and softball practicing apparatus in accordance with the prior art shown in FIGS. 7-9 comprises a housing 10 mounted on a stand 11, a ball throwing wheel 13 rotatably mounted on an inner side of the housing 10 and rotated by a motor 12, a feeding member 15 mounted on a front end of the housing 10 by a plurality of screws 14 and having an entrance 150 and two arc-shaped guide plates 16, and a press plate 18 adjustably mounted on the inner side of the housing 10 by a plurality of screws 17 and located above the ball throwing wheel 13. The press plate 18 has a bottom face provided with an arc-shaped guide member 19 that is movable with the press plate 18 to adjust the distance between the guide member 19 and the ball throwing wheel 13.

As shown in FIG. 8, the press plate 18 is located at a higher position, and the entrance 150 of the feeding member 15 having a greater diameter is exposed to allow insertion of a softball so that the softball enters the entrance 150 of the feeding member 15 and is clamped between the guide member 19 of the press plate 18 and the ball throwing wheel 13 to be ejected outward for use.

As shown in FIG. 9, the press plate 18 is located at a lower position, and the entrance 150' of another feeding member 15' having a smaller diameter is exposed to allow insertion of a baseball so that the baseball enters the entrance 150' of the feeding member 15' and is clamped between the guide member 19 of the press plate 18 and the ball throwing wheel 13 to be ejected outward for use.

However, it is necessary to screw and unscrew the screws 14 successively so as to replace the feeding member 15 and another feeding member 15' having a smaller diameter, thereby greatly causing inconvenience to a user in selecting and changing the baseball and the softball. In addition, the height of the feeding member 15 cannot be adjusted, so that the speed of the ball cannot be adjusted. Further, the housing 10 is secured on the stand 11, so that the direction and inclined angle of the entrance 150 of the feeding member 15 cannot be adjusted, thereby limiting the versatility of the practicing apparatus.

SUMMARY OF THE INVENTION

The primary objective of the present invention is to provide a practicing apparatus, wherein the hooks of the feeding member are hooked onto the transverse stubs of the housing, the movable plate of the feeding member is inserted into the slideway of the housing, and the threaded rod is screwed into the housing and extended through the movable plate of the feeding member to secure the feeding member to the housing, so that the feeding member is mounted on and detached from the housing easily and quickly by rotation of the threaded rod, thereby facilitating the user assembling and disassembling the feeding member.

Another objective of the present invention is to provide a practicing apparatus, wherein the feeding member is pivotally movable relative to the housing to change the travel speed of the ball injected from the outlet of the feeding member.

A further objective of the present invention is to provide a practicing apparatus, wherein the housing together with the feeding member-is rotatable relative to the stand about a vertical axis to rotate the outlet of the feeding member horizontally through 360 degrees so as to adjust the direction of the outlet of the feeding member.

A further objective of the present invention is to provide a practicing apparatus, wherein the housing together with the feeding member is rotatable relative to the stand about a horizontal axis to move the outlet of the feeding member upward and downward so as to adjust the angle of the outlet of the feeding member.

Further benefits and advantages of the present invention will become apparent after a careful reading of the detailed description with appropriate reference to the accompanying drawings.

DETAILED DESCRIPTION OF THE INVENTION

Figure 1:
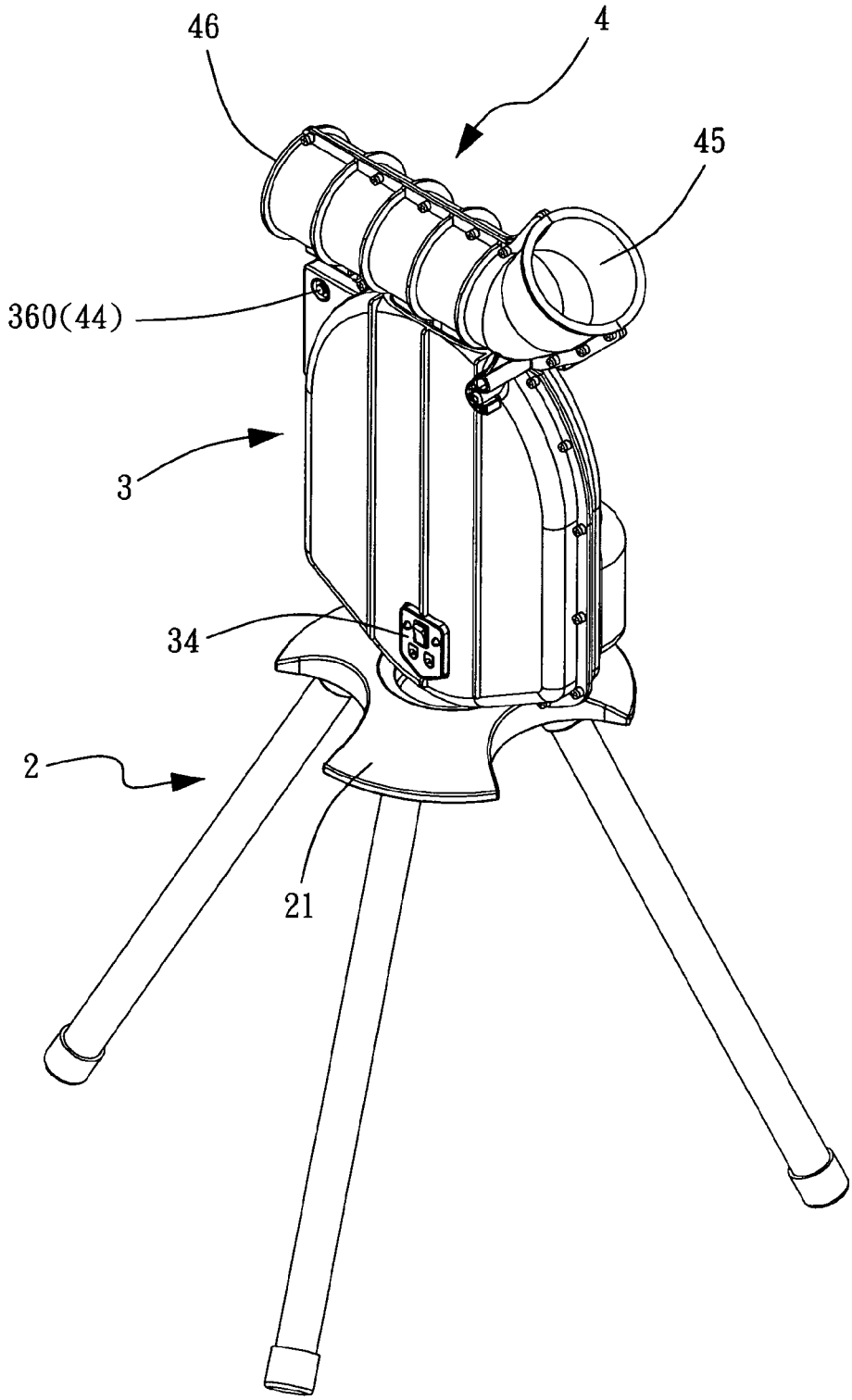
FIG. 1 is a perspective view of a practicing apparatus in accordance with the preferred embodiment of the present invention.
Figure 2:
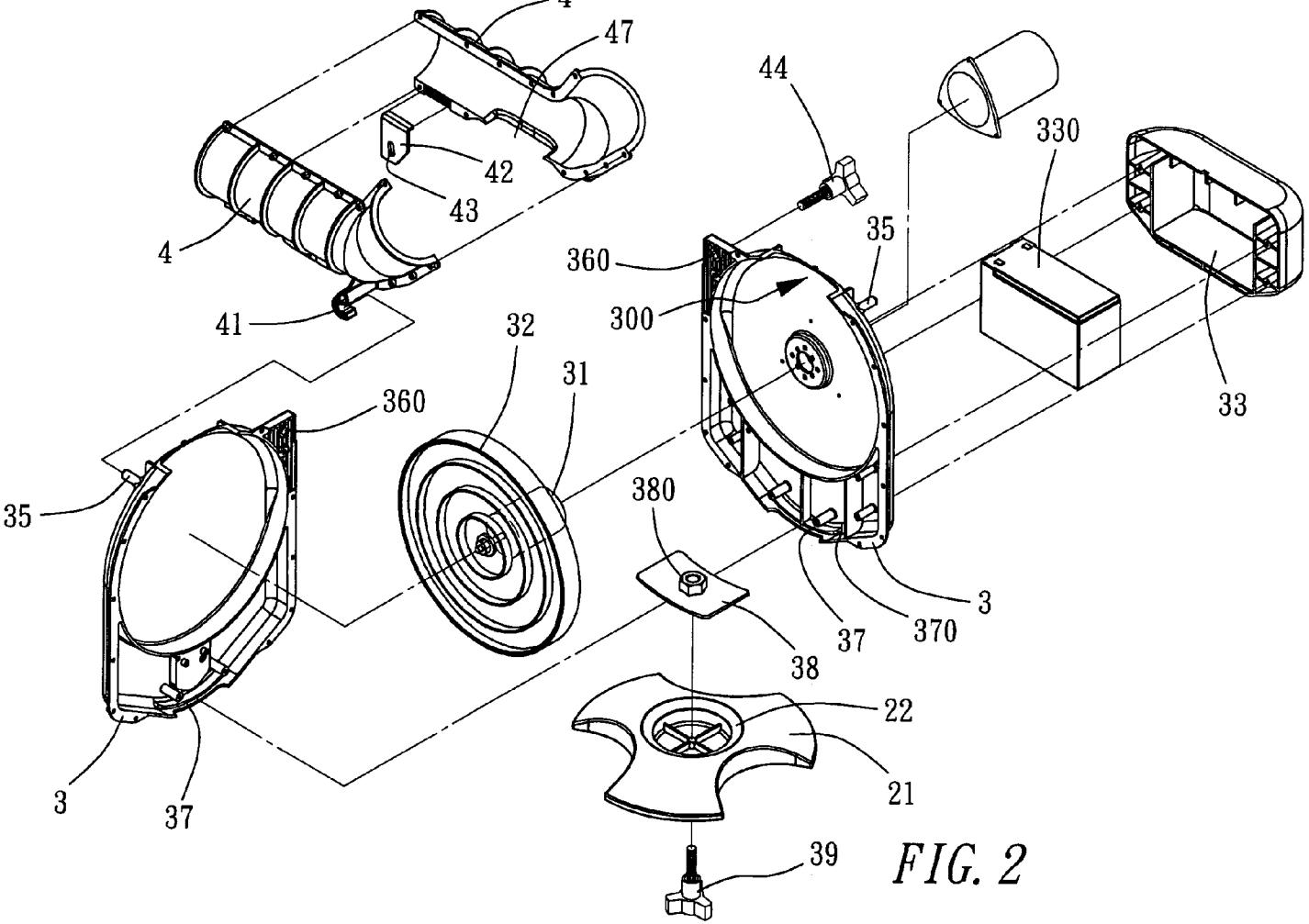
FIG. 2 is an exploded perspective view of the practicing apparatus as shown in FIG. 1.
Figure 3:
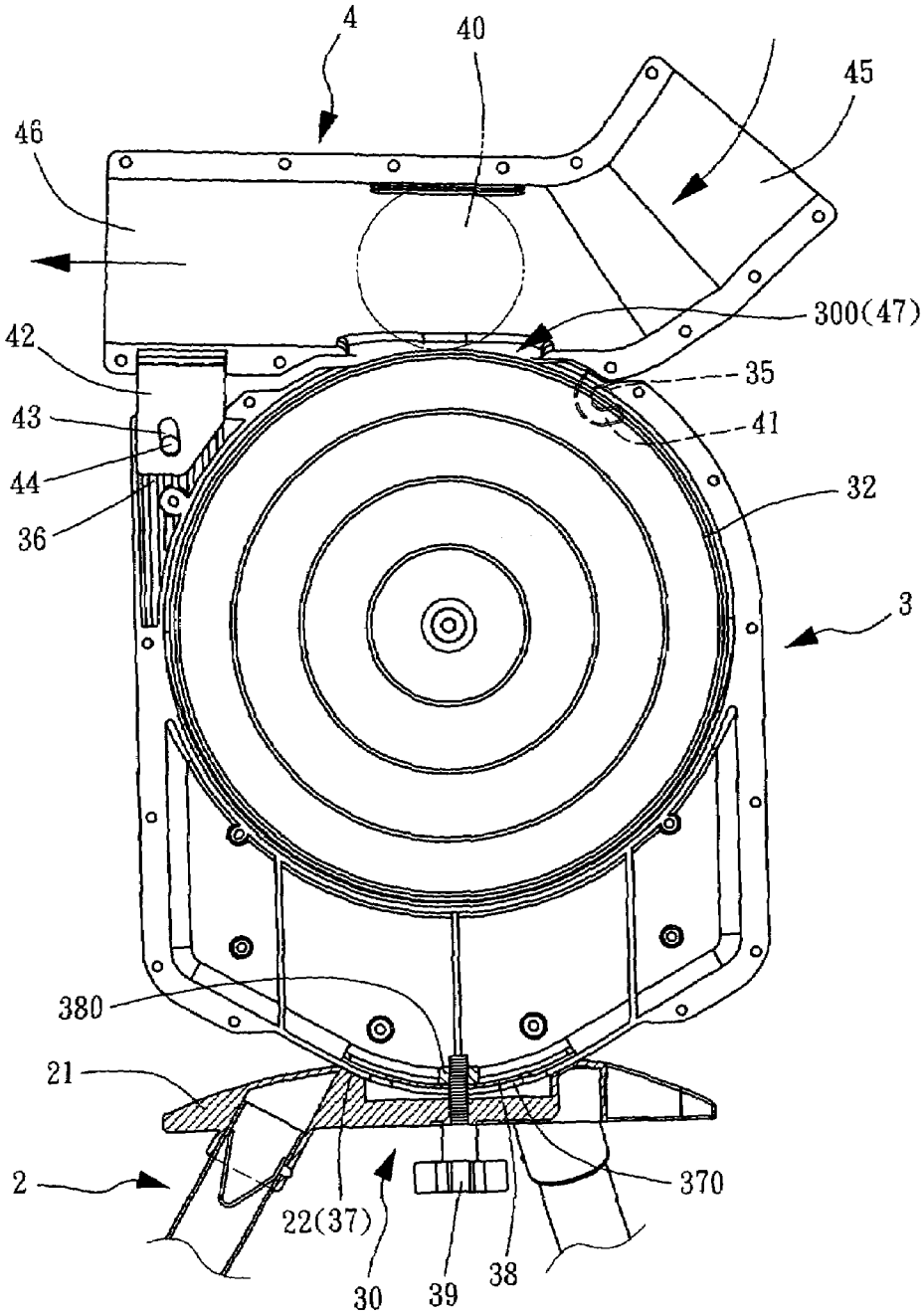
FIG. 3 is a plan cross-sectional view of the practicing apparatus as shown in FIG. 1.

Referring to the drawings and initially to FIGS. 1-3, a baseball and softball practicing apparatus in accordance with the preferred embodiment of the present invention comprises a stand 2, a housing 3 mounted on a top of the stand 2, a ball throwing wheel 32 rotatably mounted in the housing 3 and rotated by a motor 31, and a feeding member 4 mounted on a top of the housing 3.

The top of the stand 2 is provided with a support seat 21 having a central portion formed with a substantially cone-shaped concave portion 22.

The housing 3 is angle adjustably mounted on the top of the stand 2. The housing 3 has a first face provided with a switch assembly 34 and a second face provided with a battery compartment 33 to receive a battery 330 which supplies an electric power to the motor 31. The top of the housing 3 has a mediate portion formed with an opening 300. The top of the housing 3 has a first side provided with two outwardly extending transverse stubs 35 and a second side formed with a slideway 36 and a screw bore 360. The housing 3 has a bottom provided with a substantially arc-shaped convex portion 37 rotatably mounted on the concave portion 22 of the support seat 21 of the stand 2 by an adjusting device 30. The convex portion 37 of the housing 3 is formed with an adjusting slot 370 which is substantially arc-shaped.

The adjusting device 30 includes a substantially arc-shaped fixing plate 38 disposed in the housing 3 and rested on the convex portion 37 of the housing 3, and a threaded rod 39 extended through the support seat 21 of the stand 2, the adjusting slot 370 of the housing 3 and screwed into the fixing plate 38 to secure the housing 3 to the support seat 21 of the stand 2. The fixing plate 38 has a top provided with a locking nut 380 screwed onto the threaded rod 39. Thus, the threaded rod 39 is movable in the adjusting slot 370 of the housing 3 when the housing 3 is rotatable relative to the stand 2.

The feeding member 4 is angle adjustably mounted on the top of the housing 3. The feeding member 4 has a cylindrical shape and has a mediate portion having a peripheral wall formed with an opening 47 facing the opening 300 of the housing 3. The feeding member 4 has a first side provided with two hooks 41 hooked onto the transverse stubs 35 of the housing 3 respectively and a second side provided with a movable plate 42 movably mounted in the slideway 36 of the housing 3 and having an elongated adjusting slot 43 aligning with the screw bore 360 of the housing 3. The feeding member 4 has a first end formed with an entrance 45 and a second end formed with an outlet 46 to allow passage of a baseball (or softball) 40.

A threaded rod 44 is screwed into the screw bore 360 of the housing 3 and extended through the adjusting slot 43 of the movable plate 42 of the feeding member 4 to secure the feeding member 4 to the housing 3. Thus, the threaded rod 44 is movable in the adjusting slot 43 of the movable plate 42 of the feeding member 4 when the movable plate 42 of the feeding member 4 is movable relative to the threaded rod 44.

The ball throwing wheel 32 is extended through the opening 300 of the housing 3 into the opening 47 of the feeding member 4 as shown in FIG. 3.

Figure 4:
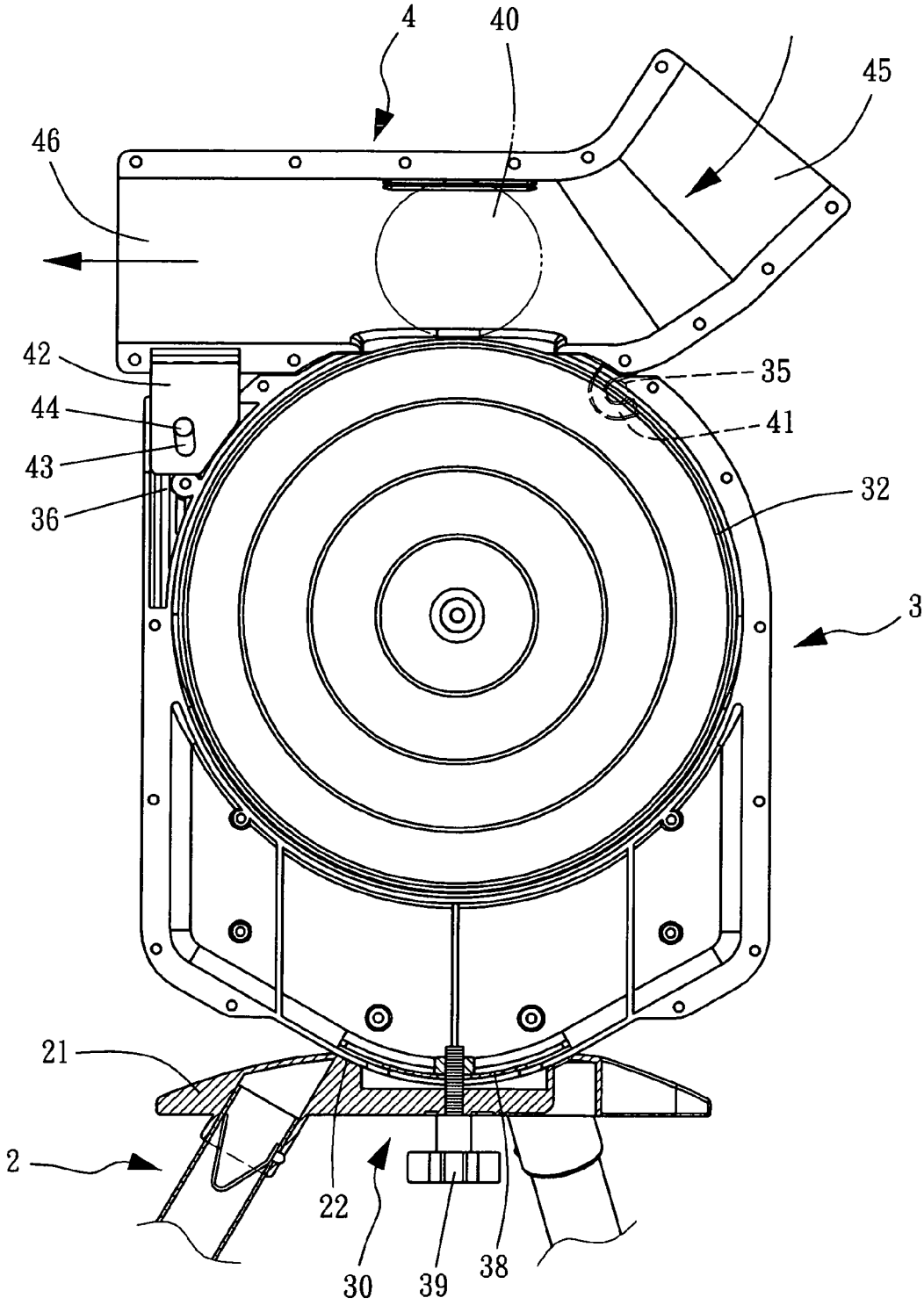
FIG. 4 is a schematic operational view of the practicing apparatus as shown in FIG. 3.

As shown in FIGS. 3 and 4, after the movable plate 42 of the feeding member 4 is loosened from the threaded rod 44 by rotation of the threaded rod 44, the movable plate 42 of the feeding member 4 is movable in the slideway 36 of the housing 3 to pivotally move the feeding member 4 relative to the housing 3 to change the distance between the inner wall of the feeding member 4 and the ball throwing wheel 32, so that the ball 40 passing trough the feeding member 4 is squeezed by the ball throwing wheel 32 with different extents, so as to change the travel speed of the ball 40 which is injected from the outlet 46 of the feeding member 4.

Figure 5:
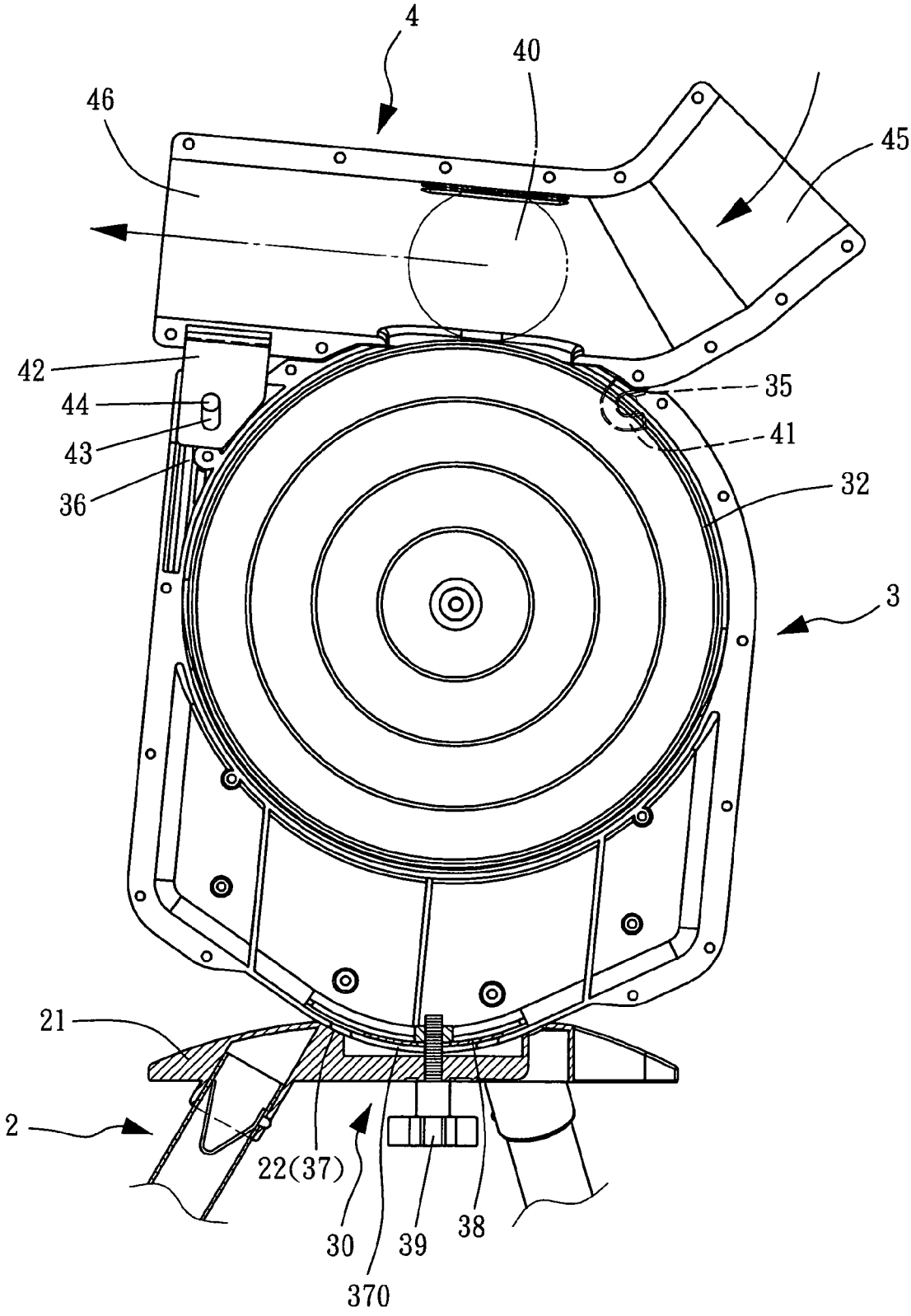
FIG. 5 is a schematic operational view of the practicing apparatus as shown in FIG. 4.
Figure 6:
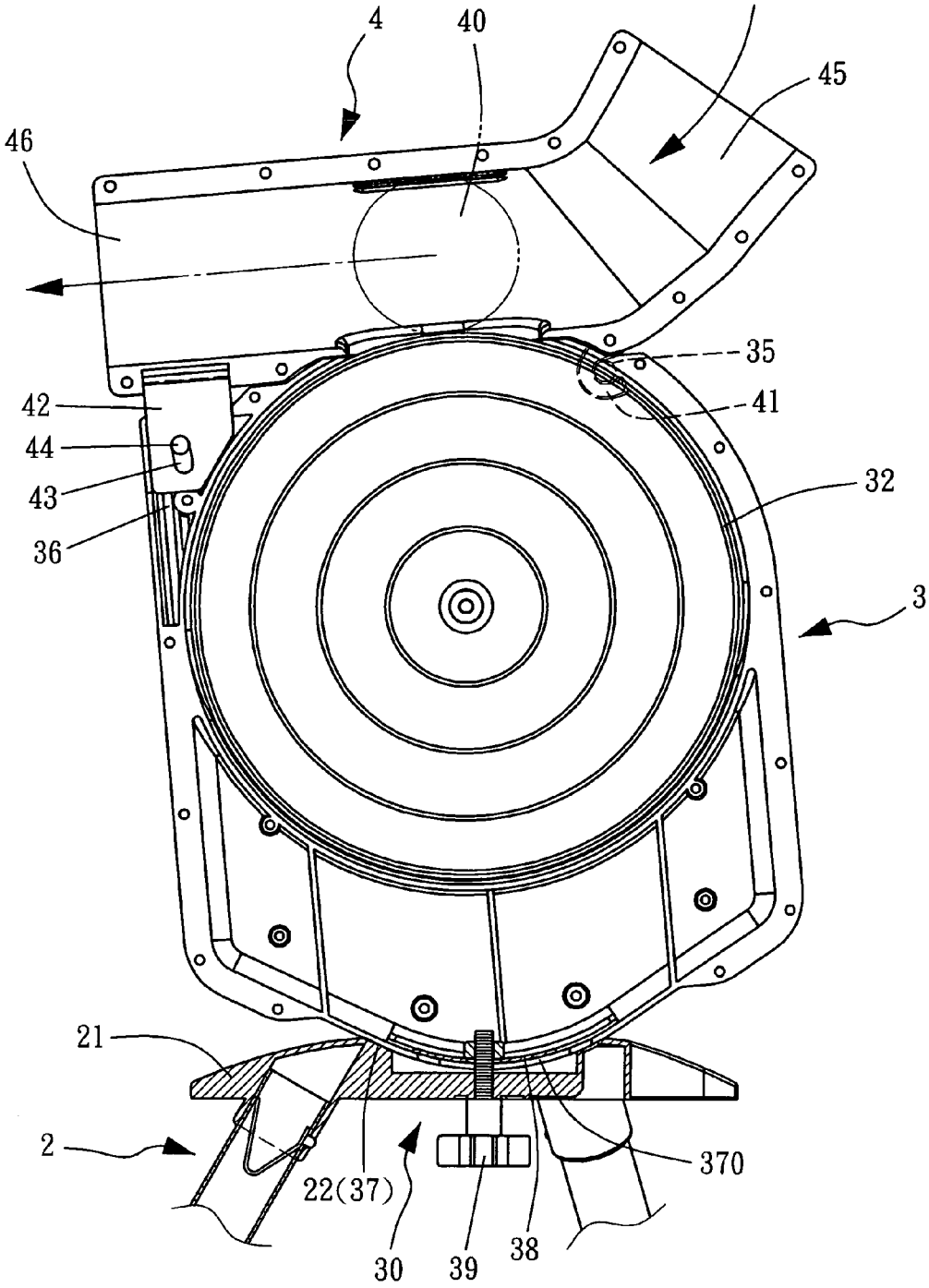
FIG. 6 is a schematic operational view of the practicing apparatus as shown in FIG. 4.
Figure 7:
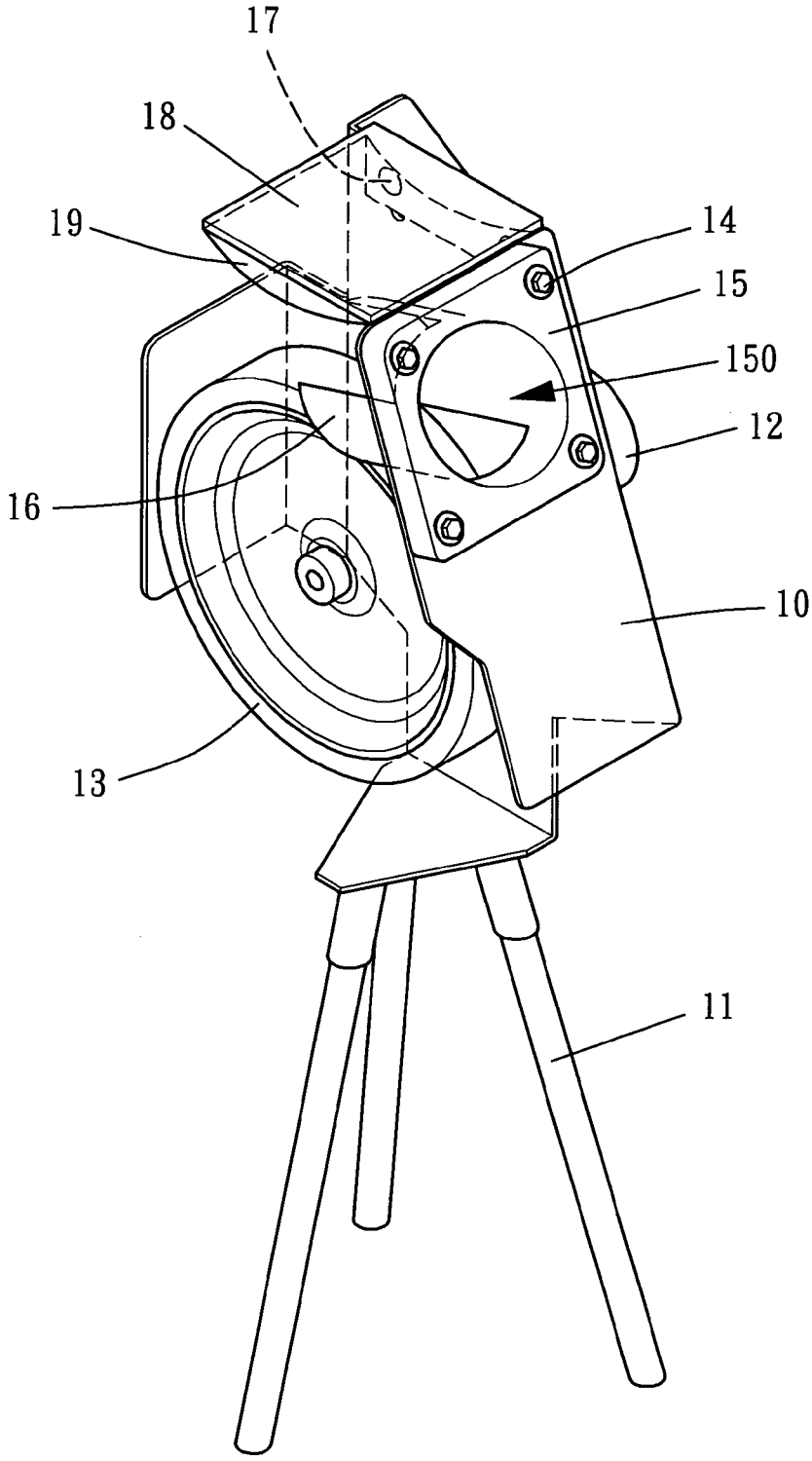
FIG. 7 (PRIOR ART)
FIG. 7 is a perspective view of a conventional practicing apparatus in accordance with the prior art.
Figure 8:
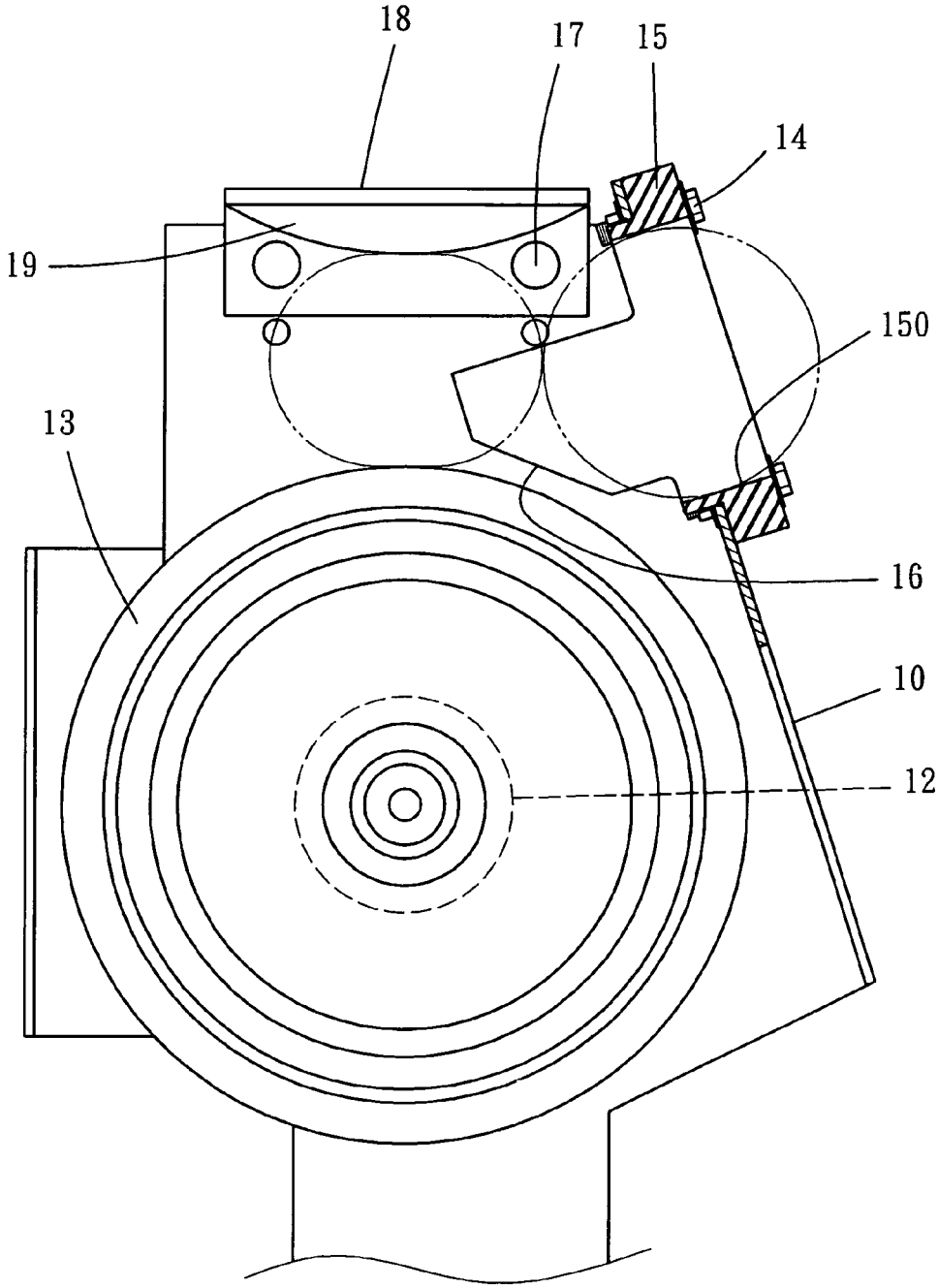
FIG. 8 (PRIOR ART)
FIG. 8 is a plan cross-sectional view of the conventional practicing apparatus as shown in FIG. 7.
Figure 9:
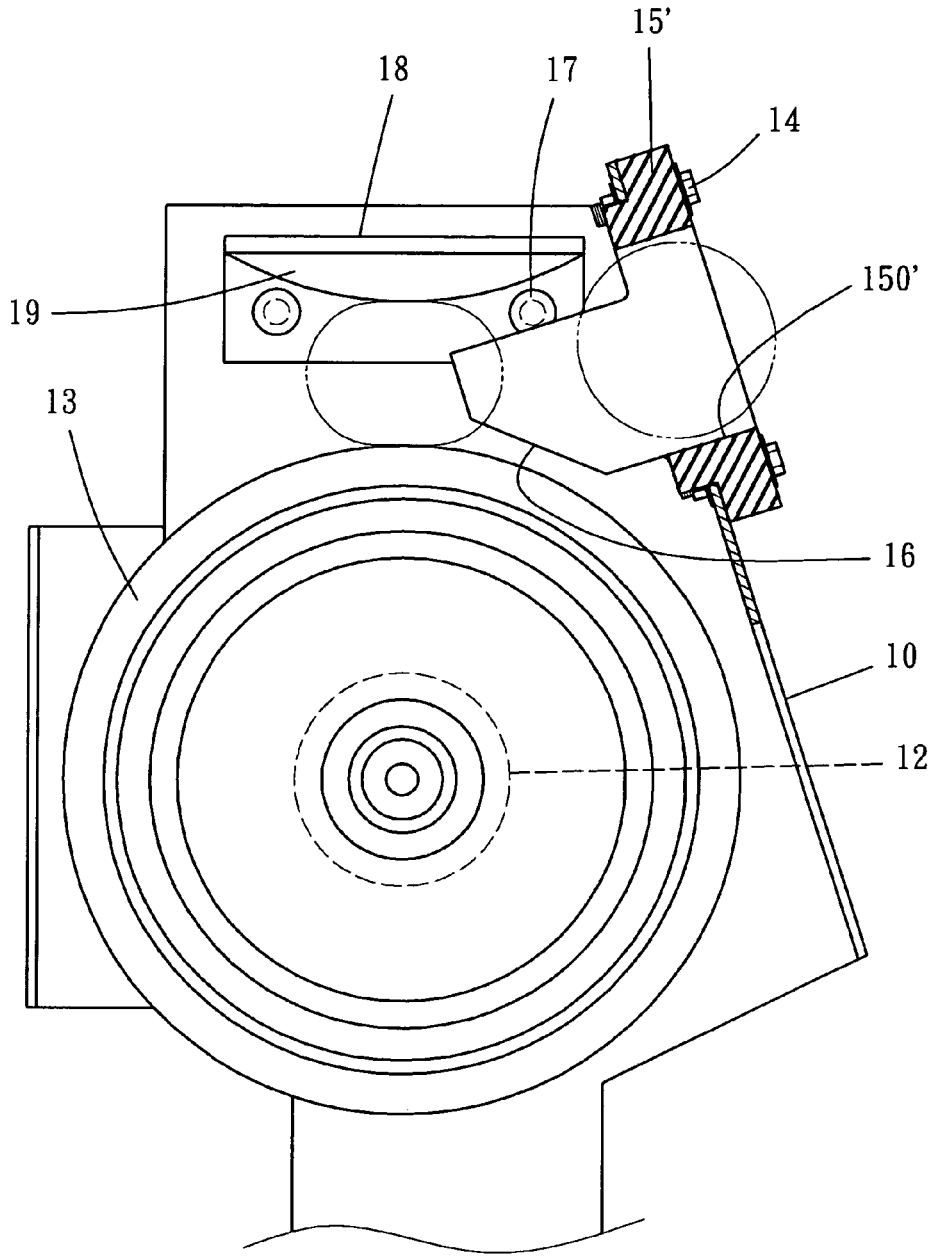
FIG. 9 (PRIOR ART)
FIG. 9 is a schematic operational view of the conventional practicing apparatus as shown in FIG. 8.

As shown in FIGS. 4-6, after the threaded rod 39 is unscrewed from the locking nut 380 of the fixing plate 38, the housing 3 is loosened from the support seat 21 of the stand 2, so that the convex portion 37 of the housing 3 is rotatable on the concave portion 22 of the stand 2.

Thus, the housing 3 together with the feeding member 4 is rotatable relative to the stand 2 about the threaded rod 39 to rotate the outlet 46 of the feeding member 4 horizontally through 360 degrees so as to adjust the direction of the outlet 46 of the feeding member 4.

Alternatively, the housing 3 together with the feeding member 4 is rotatable relative to the stand 2 about a horizontal axis to move the outlet 46 of the feeding member 4 upward as shown in FIG. 5 and downward as shown in FIG. 6 so as to adjust the angle of the outlet 46 of the feeding member 4. At this time, the threaded rod 39 is movable in the adjusting slot 370 of the housing 3 when the housing 3 is rotatable relative to the stand 2.

Accordingly, the hooks 41 of the feeding member 4 are hooked onto the transverse stubs 35 of the housing 3, the movable plate 42 of the feeding member 4 is inserted into the slideway 36 of the housing 3, and the threaded rod 44 is screwed into the housing 3 and extended through the movable plate 42 of the feeding member 4 to secure the feeding member 4 to the housing 3, so that the feeding member 4 is mounted on and detached from the housing 3 easily and quickly by rotation of the threaded rod 44, thereby facilitating the user assembling and disassembling the feeding member 4. In addition, the feeding member 4 is pivotally movable relative to the housing 3 to change the travel speed of the ball 40 injected from the outlet 46 of the feeding member 4. Further, the housing 3 together with the feeding member 4 is rotatable relative to the stand 2 about a vertical axis to rotate the outlet 46 of the feeding member 4 horizontally through 360 degrees so as to adjust the direction of the outlet 46 of the feeding member 4. Further, the housing 3 together with the feeding member 4 is rotatable relative to the stand 2 about a horizontal axis to move the outlet 46 of the feeding member 4 upward and downward so as to adjust the angle of the outlet 46 of the feeding member 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A practicing apparatus, comprising:

a stand;

a housing mounted on a top of the stand;

a ball throwing wheel rotatably mounted in the housing and rotated by a motor;

a feeding member mounted on a top of the housing;

wherein the top of the stand is provided with a support seat formed with a concave portion, and the housing has a bottom provided with a convex portion rotatably mounted on the concave portion of the support seat of the stand by an adjusting device;

the convex portion of the housing is formed with an adjusting slot, and the adjusting device includes a fixing plate disposed in the housing and rested on the convex portion of the housing, and a threaded rod extended through the support seat of the stand, the adjusting slot of the housing and screwed into the fixing plate to secure the housing to the support seat of the stand.

2. The practicing apparatus in accordance with claim 1, wherein the concave portion of the support seat of the stand is substantially cone-shaped.

3. The practicing apparatus in accordance with claim 1, wherein the convex portion of the housing is substantially arc-shaped.

4. The practicing apparatus in accordance with claim 1, wherein the adjusting slot of the housing is substantially arc-shaped.

5. The practicing apparatus in accordance with claim 1, wherein the fixing plate is substantially arc-shaped.

6. The practicing apparatus in accordance with claim 1, wherein the fixing plate has a top provided with a locking nut screwed onto the threaded rod.

7. The practicing apparatus in accordance with claim 1, wherein the threaded rod is movable in the adjusting slot of the housing when the housing is rotatable relative to the stand.

8. The practicing apparatus in accordance with claim 1, wherein the housing together with the feeding member is rotatable relative to the stand about the threaded rod to rotate the feeding member horizontally through 360 degrees so as to adjust a direction of the feeding member.

9. The practicing apparatus in accordance with claim 1, wherein the housing together with the feeding member is rotatable relative to the stand about a horizontal axis to move the feeding member upward and downward so as to adjust an angle of the feeding member.

10. The practicing apparatus in accordance with claim 9, wherein the threaded rod is movable in the adjusting slot of the housing when the housing is rotatable relative to the stand.

11. The practicing apparatus in accordance with claim 1, wherein the housing is angle adjustably mounted on the top of the stand.

12. The practicing apparatus in accordance with claim 1, wherein the feeding member is angle adjustably mounted on the top of the housing.

13. The practicing apparatus in accordance with claim 1, wherein the top of the housing has a mediate portion formed with an opening, the feeding member has a mediate portion having a peripheral wall formed with an opening facing the opening of the housing, and the ball throwing wheel is extended through the opening of the housing into the opening of the feeding member.

14. The practicing apparatus in accordance with claim 1, wherein the feeding member has a cylindrical shape.

15. The practicing apparatus in accordance with claim 1, wherein the feeding member has a first end formed with an entrance and a second end formed with an outlet.

16. A practicing apparatus, comprising:

a stand;

a housing mounted on a top of the stand;

a ball throwing wheel rotatably mounted in the housing and rotated by a motor;

a feeding member mounted on a top of the housing;

wherein the top of the stand is provided with a support seat formed with a concave portion, and the housing has a bottom provided with a convex portion rotatably mounted on the concave portion of the support seat of the stand by an adjusting device;

the top of the housing has a first side provided with two outwardly extending transverse stubs and a second side formed with a slideway and a screw bore, the feeding member has a first side provided with two hooks hooked onto the transverse stubs of the housing respectively and a second side provided with a movable plate movably mounted in the slideway of the housing and having an elongated adjusting slot aligning with the screw bore of the housing, and the practicing apparatus further comprises a threaded rod screwed into the screw bore of the housing and extended through the adjusting slot of the movable plate of the feeding member to secure the feeding member to the housing.

17. The practicing apparatus in accordance with claim 16, wherein the threaded rod is movable in the adjusting slot of the movable plate of the feeding member when the movable plate of the feeding member is movable relative to the threaded rod.

18. The practicing apparatus in accordance with claim 16, wherein after the movable plate of the feeding member is loosened from the threaded rod by rotation of the threaded rod, the movable plate of the feeding member is movable in the slideway of the housing to pivotally move the feeding member relative to the housing to change a distance between an inner wall of the feeding member and the ball throwing wheel.

* * * * *